US005604961A

United States Patent [19]

Cole

[11] Patent Number: 5,604,961

[45] Date of Patent: Feb. 25, 1997

[54] MULTIPLE PURPOSE FASTENING DEVICE, SYSTEM AND METHOD

[75] Inventor: Robert G. Cole, Rogers, Ark.

[73] Assignee: Fox Ridge Enterprises, Inc., Rogers, Ark.

[21] Appl. No.: 501,203

[22] Filed: Jul. 11, 1995

[51] Int. Cl.[6] ..... B65D 63/00

[52] U.S. Cl. ..... 24/306; 24/442; 24/452

[58] Field of Search ..... 24/306, 442, 450, 24/452; 128/DIG. 15

[56] References Cited

U.S. PATENT DOCUMENTS

| | | | |
|---|---|---|---|
| 3,000,384 | 9/1961 | Piers, Jr. | 132/46 |
| 3,022,557 | 2/1962 | Logan | 24/17 |
| 3,063,718 | 11/1962 | Steinkamp | 128/DIG. 15 |
| 3,241,881 | 3/1966 | Carnahan et al. | 24/306 |
| 3,279,008 | 10/1966 | Wallach | 24/306 |
| 3,638,284 | 2/1972 | Baker | 24/306 |
| 3,940,873 | 3/1976 | Lawless | 24/442 |
| 3,994,048 | 11/1976 | Rosenthal | 24/81 |
| 4,273,130 | 6/1981 | Simpson | 128/327 |
| 4,414,969 | 11/1983 | Heyman | 128/133 |
| 4,671,787 | 6/1987 | Widman | 128/DIG. 15 |
| 4,862,563 | 9/1989 | Flynn | 24/442 |
| 4,878,274 | 11/1989 | Patricy | 24/306 |
| 4,888,830 | 12/1989 | Putnam | 2/327 |
| 4,893,381 | 1/1990 | Frankel | 24/16 |
| 4,939,818 | 7/1990 | Hahn | 24/16 |
| 4,963,410 | 10/1990 | Bryant | 428/100 |
| 5,008,987 | 4/1991 | Armour, II | 24/442 |
| 5,015,251 | 5/1991 | Cherubini | 128/DIG. 15 |
| 5,048,158 | 9/1991 | Koerner | 24/16 |
| 5,075,933 | 12/1991 | Kemper | 24/16 |
| 5,086,543 | 2/1992 | Mitchell | 24/442 |
| 5,136,759 | 8/1992 | Armour, II | 24/442 |
| 5,167,050 | 12/1992 | Korsen | 24/16 |
| 5,168,603 | 12/1992 | Reed | 24/16 |
| 5,200,245 | 4/1993 | Brodrick, Jr. | 24/306 |
| 5,289,619 | 3/1994 | Pileggi | 24/306 |

OTHER PUBLICATIONS

Velcro Product Information Guide, Sep. 1994.

*Primary Examiner*—Victor N. Sakran

*Attorney, Agent, or Firm*—Daniel R. Alexander; Head, Johnson & Kachigian

[57] ABSTRACT

A multiple purpose fastening device, system and method is provided which utilizes one or more fastening elements having an elongate flexible member with respective releasably interengaging, interlocking, or compressively joining, coupling or adhering opposing surfaces covering the entire length thereof with the exception of an end tab, gripping surface or end loop at at least one end thereof. The fastening apparatus of the present invention is not limited to a particular size or dimension. A method of fastening, joining, bundling, and/or the like one or more objects together employs one or more of the fastening devices of the present invention wrapped around one or more objects in a common direction to overlap or superimpose upon itself with the opposing releasable coupling surfaces joined over a portion of each flexible member. The end loops provide an anchoring point for attachment of additional devices, accessories, clips, and the like.

10 Claims, 3 Drawing Sheets

MULTIPLE PURPOSE FASTENING DEVICE, SYSTEM AND METHOD

BACKGROUND OF THE INVENTION

The present invention relates to methods and apparatus for fastening, bundling, retaining, binding, securing, anchoring, baling, banding, clinching, packaging, palletizing, coiling, wrapping, tying, taping, joining, attaching, and the like, one or more items using flexible, releasable apparatus. More particularly, the present invention relates to fastening devices, systems, and methods utilizing one or more flexible members having respective releasably interlocking or interengaging opposing surfaces and either an end tab or end loop at one or both of the free ends thereof.

U.S. Pat. Nos. 3,994,048, 4,862,563, 4,893,381, 4,963,410, 5,075,933, and 5,167,050 disclose relatively complicated fastening or bundling devices, ties, or straps, including a plurality of flexible strap segments joined together and diverse arrangements or patterns of interlocking or interengaging synthetic filamentary hooks and loops which adhere to one another when pressed together and can be pulled apart to form a releasable interconnection therebetween. Such synthetic hook and loop materials are sold under the trademark VELCRO.

U.S. Pat. Nos. 3,000,384, 4,878,274, 4,939,818, and 5,168,603 disclose less complex fastening, bundling, or securing devices or ties, including a single elongate flexible strap. However, these devices still include a diverse arrangement or pattern of interlocking or interengaging hook and loop materials. This limits the adjustability of the device since interengagement of the hook material with the loop material requires that the device be used in a certain configuration or wrapped around one or more items having a certain size.

U.S. Pat. No. 5,048,158 discloses a keeper for coiled items including a single flexible strap having respective loops and hooks on opposite sides throughout the entire surface of the keeper. In one embodiment, the keeper includes a slot through the strap for forming a first smaller loop around a single strand of a coiled item such as electrical cord, garden hose, or the like, to retain the keeper on the item. In another embodiment, the keeper is twisted near its midsection, and the cooperating loops and hooks are brought into interlocking engagement to form a first smaller loop which fits around a single strand of the coiled item. These keepers suffer from the drawback of not having an end tab or easily gripped surface at the free end thereof to facilitate removal of the keeper from around a coiled item. Also, the slotted embodiment suffers from the drawbacks of having to feed the free end of the keeper through the slot which is made difficult by inadvertent engagement of the hooks and loops during application of the keeper and having a slot in the strap which tends to weaken the strap and can lead to structural failure of the keeper.

Hence, there is a need for an improved fastening, bundling, securing, and/or the like, apparatus and method which is not only flexible and releasable, but also relatively simple and sturdy in design, easy to utilize, adjustable, versatile, reversible, and/or reusable.

SUMMARY OF THE INVENTION

In accordance with the present invention, a multiple purpose fastening device, system and method is provided which utilizes one or more fastening elements having an elongate flexible member with respective releasably interengaging, interlocking, or compressively adhering opposing surfaces covering the entire length thereof with the exception of an end tab or end loop at at least one end thereof. The fastening apparatus of the present invention is not limited to a particular size or dimension and finds equal utility in banding, bundling, fastening, retaining, binding, securing, anchoring, interlocking, bonding, attaching, joining, baling, clinching, packaging, palletizing, stacking, coiling, wrapping, taping, arranging, and/or the like, using one or more of the fastening elements of the present invention.

In accordance with a particular embodiment of the present invention, a fastening system includes a plurality of fastening devices, each including an elongate flexible member having respective opposing releasably interlocking, interengaging, or compressively adhering surfaces, for example, filamentary loops and hooks, which provide releasable coupling surfaces over the entire opposing planar surfaces of the elongate member with the exception of at least one of the free ends thereof. One or both of the free ends of the flexible member have an end tab, a smooth gripping surface, and/or an end loop.

In accordance with still yet another embodiment of the present invention, a method of fastening, joining, bundling, and/or the like, one or more objects together employs one or more of the fastening devices of the present invention wrapped around one or more objects in a common direction to overlap or superimpose upon itself with the opposing releasable coupling surfaces joined over a portion of each flexible member.

The end tabs, gripping surfaces, and/or end loops provide for quick and easy removal or adjustment of the fastening device or fastening system and facilitate the use of the fastening device or fastening system with a minimal effort and increased comfort to the user. The end loop or loops also enhance the versatility of the device and system and provide an anchoring point for attachment of additional devices, accessories, clips, and the like.

In accordance with the present invention, the fastening device and system of the present invention is especially useful in fastening, bundling, clinching, coiling, wrapping, and/or the like, coiled or rolled items such as computer cables or cords, rope, electrical cable, extension cords, garden hoses, etc. Further, the fastening device and system of the present invention enjoys the advantages of being detachable, portable, reusable, flexible, versatile, effective, efficient, reversible, adjustable, extensible, combinable, and/or the like. Moreover, the fastening device and system of the present invention is adapted for use in different sizes, for example, small sizes for use in binding or bundling one or more cables behind a personal computer, medium sizes for use in binding or bundling extension cords, garden hoses, ski ropes, and large sizes for palletizing, packaging, arranging, or transporting larger items or larger numbers of items.

The principal object of the present invention is the provision of a fastening device including an elongate flexible member having respective opposing releasably interlocking, interengaging or compressively adhering surfaces and an end tab, gripping surface and/or end loop at one or both of the free ends thereof.

Another object of the present invention is the provision of a fastening system including a plurality of fastening devices with each device including an elongate flexible member having opposing releasable coupling surfaces and an end tab, gripping surface and/or end loop at one or both of the free ends thereof.

A still further object of the present invention is the provision of a method of fastening, bundling, securing, or the like one or more objects together using one or more fastening devices with each device including an elongate flexible member having opposing releasable interlocking, interengaging, or adhering surfaces and an end tab, gripping surface and/or end loop at at least one of the free ends thereof.

Other objects and further scope of the applicability of the present invention will become apparent from the detailed description to follow, taken in conjunction with the accompanying drawings wherein like parts are designated by like reference numerals.

DETAILED DESCRIPTION OF THE PREFERRED EMBODIMENTS

Figure 1:
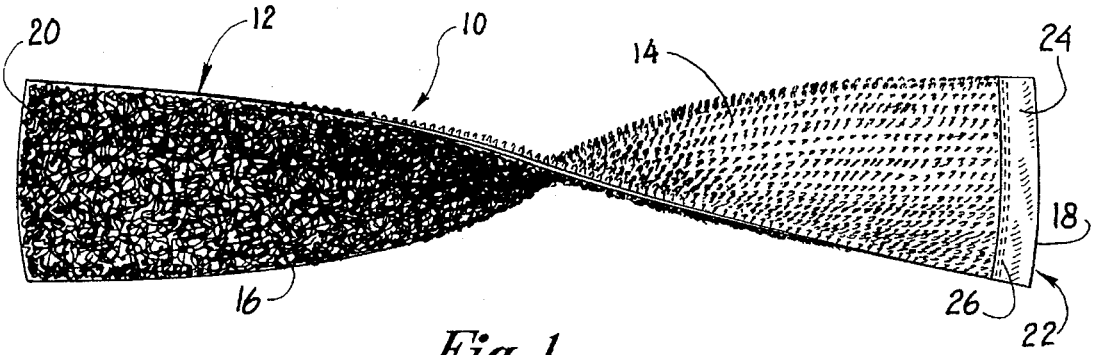
FIG. 1 is a plan view illustration of a fastening device in accordance with one embodiment of the present invention with the device twisted to show opposing surfaces thereof.
Figure 2:
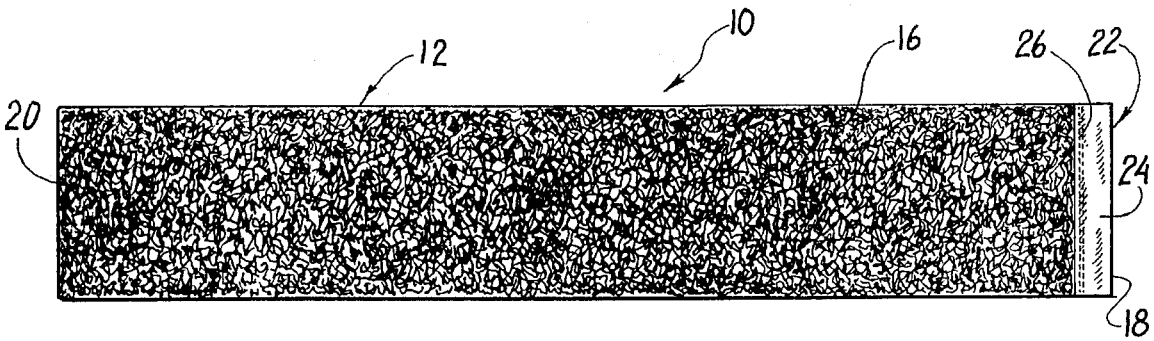
FIG. 2 is a top plan view representation of the fastening device of FIG. 1.
Figure 3:
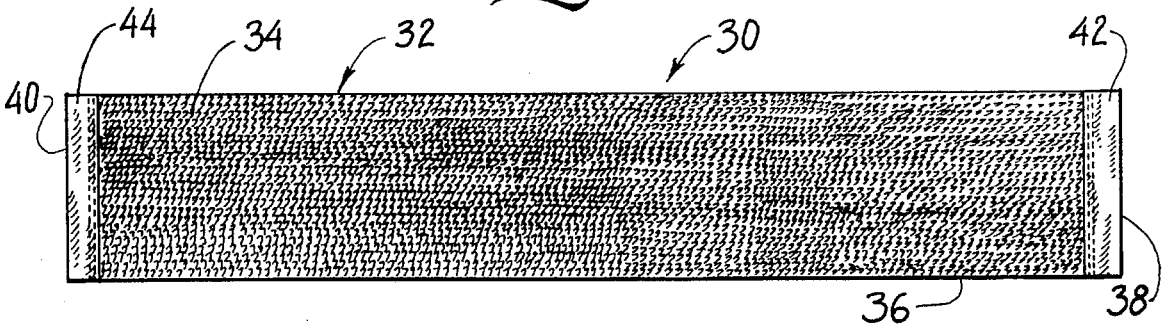
FIG. 3 is a bottom plan view illustration of a fastening device in accordance with another embodiment of the present invention.

In accordance with an exemplary embodiment of the present invention as shown in FIGS. 1 and 2 of the drawings, a fastening device or apparatus generally designated by the reference numeral 10 includes an elongate flexible member or strap 12 having opposing respective releasably interlocking, interengaging, compressively joining, mating, coupling, or adhering hook and loop surfaces 14 and 16 and first and second free ends 18 and 20. The free end 18 of elongate member 12 includes an end tab or smooth gripping surface 22 including a length of material 24 wrapped around the end 18 and secured to member 12 by stitching, sewing, gluing, or welding 26.

In accordance with a particular example of the present invention, the fastening device 10 is made up of flexible strips of VELCRO brand synthetic filamentary hook and loop materials joined back-to-back by heat sealing or welding, or glue, solvents, cements, or adhesives to form an elongate flexible member 12 having opposing releasably interengaging, interlocking, compressively coupling or adhering surfaces which when brought together form a releasable interlock. The end tab 22 is made from a flexible material, such as leather, cloth, or nylon, wrapped over the end 18 of elongate member 12 and permanently attached to the elongate member via stitching, sewing, gluing or heat sealing 26.

In operation, the fastening device 10 is used to join one or more items together starting with the end 20 of elongate member 12 placed against one object and wrapping around the object or objects and ending with a portion of interengaging surfaces 14 and 16 in abutting and compressively joined relation with end tab 22 on the outer surface of the bundle to facilitate the removal of the fastening device 10 from around the objects when desired. The fastening device 10 is adjustable in that the releasably interlocking surfaces 14 and 16 cover the entire surface of the elongate member 12 with the exception of end tab 22. This allows the device to be used around different sizes and groupings of articles since securement of the device only requires that a limited portion of the surface 14 contact the surface 16 and be compressively joined thereto. The smaller the group of articles to be bound one to another, the larger the portion of respective surfaces 14 and 16 which are compressively joined.

In accordance with another example of the present invention, the elongate member 12 is formed of a length of VELCRO brand back-to-back self-wrapping, reusable woven knit tape, or reusable hook-to-loop tape with an end tab at one end thereof formed of a length of leather or other flexible material wrapped over the end of the segment and permanently attached thereto by stitching, gluing, sealing, etc.

Although it is preferred to use compressively coupled releasable hook and loop type synthetic filamentary surfaces, it is to be understood that other compressively coupled or joining, reusable, releasable materials may be used. For example, VELCRO brand molded hook materials, woven materials, or self-engaging fastener materials, or other reusable, releasable adhesive surfaces, such as, resealable adhesives, pressure activated adhesives, and the like may be used.

A plurality of fastening devices 10 may be joined one to another to form an elongate fastening device or system having an overall length and/or width greater than that of a single member 12.

Figure 10:
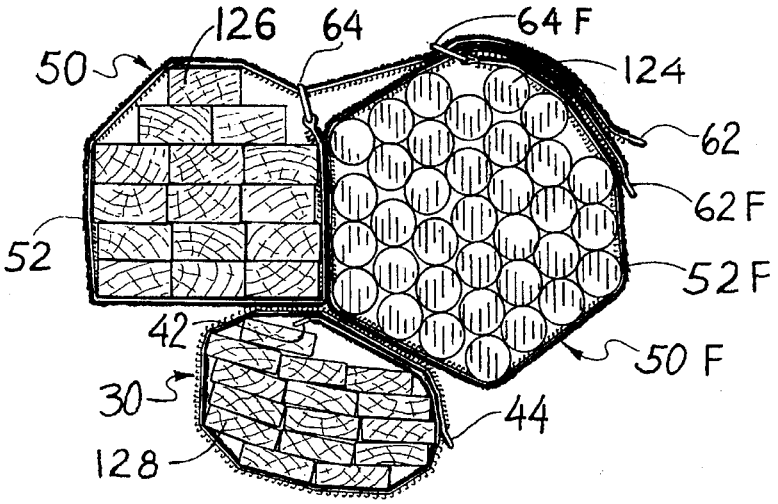
FIG. 10 is a side view illustration of a plurality of fastening devices or a fastening system incorporating a plurality of fastening devices of the type shown in FIGS. 3 and 4 in use bundling or binding differing groups of objects and joining the respective bundles one to another.

The fastening device 10 is reversible in that one can wrap the elongate member 12 around one or more articles or items starting with end 20 and with either the hook material 14 against the articles, or with the loop material 16 against the articles. If the hook material 14 has a tendency to either adhere to one or more of the articles, or to adhere to items or articles external thereto, the user can selectively locate the hook material 14 either inwardly toward the items being bound, or outwardly away therefrom. A plurality of bundles of articles or items can be joined one to another using a plurality of the flexible devices 10 by alternating between having the surface 14 of each device 10 directed toward or away from the items being fastened or bundled together (FIG. 10). Thus, the external surfaces of adjacent fastening devices 10 can be joined one to another and form a large or combination bundle made up of separate smaller bundles joined one to another. Thus, the fastening device 10 is highly versatile, adjustable, flexible, extensible, relatively inexpensive, sturdy, and the like.

It is contemplated that the elongate member 12 may be dimensioned in a variety of length and width dimensions to accommodate different purposes, and items or articles to be bound, secured, tied, banded, bundled, fastened, retained, anchored, interlocked, baled, clinched, packaged, palletized, stacked, coiled, wrapped, taped, etc. For example, in accordance with a particular example of the fastening device 10 useful in securing cables behind a personal computer to bind these cables for shipment or storage, transportation, or simply to bind them in convenient space saving groupings or an aesthetically pleasing arrangement, a fastening device 10 having a width of about one inch and an overall length of about six inches is preferred. Also, the end tab 22 has a width of one inch, the same as the width of the elongate member 12, and has a length of about one-quarter of an inch to provide a surface easily gripped by the thumb and forefinger of the user. The end tab 22 facilitates the removal of the fastening device 10 and in so doing allows the user to remove the device using just one hand, and thereby frees the other hand for grabbing cables or lifting the computer, etc.

As shown in FIGS. 3, 6, 8, and 10 of the drawings, in accordance with another exemplary embodiment of the present invention, a fastening device generally designated by the reference numeral 30 is identical to the fastening device 10 with the exception of an additional end tab at the second end of the elongate member. The fastening device 30 includes an elongate flexible member or strap 32 having opposing releasably interlocking, interengaging, compressively coupling or joining surfaces 34 and 36, first and second free ends 38 and 40, and first and second end tabs 42 and 44 at each of the free ends. Having an end tab or gripping surface 42 and 44 at each of the free ends of the elongate member 32 enhances the versatility of the fastening device 30. Either end of the fastening device 30 can be used as the starting end to start the wrapping or fastening of the device about one or more objects or items.

In accordance with a particular example of the present invention, the fastening device 30 is formed of a length of VELCRO brand back-to-back reusable hook-to-loop tape with each of end tabs 42 and 44 formed of a piece of leather or cloth, folded over the free ends thereof and permanently attached to the tape via stitching with heavy duty thread, or the like.

Figure 4:
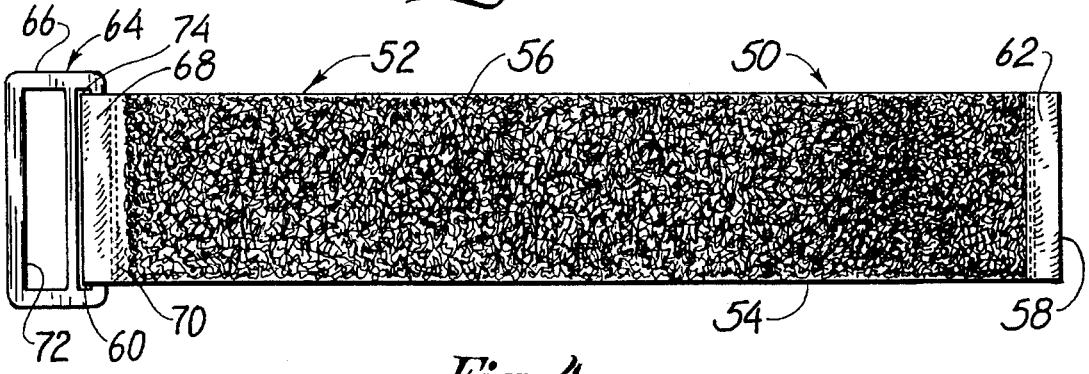
FIG. 4 is a top plan view representation of a fastening device in accordance with yet another embodiment of the present invention.

In accordance with yet another exemplary embodiment of the present invention as shown in FIG. 4 of the drawings, a fastening device generally designated by the reference numeral 50 is identical to the fastening device 10 of FIGS. 1 and 2, except for having an end loop added at the end opposite the end tab. The fastening device 50 includes an elongate flexible member, strap, or tape 52 having opposing releasably interlocking, interengaging, compressively coupled or joined surfaces 54 and 56, and first and second free ends 58 and 60. The end tab or gripping surface 62 is located at free end 58 and an end loop 64 is added at end 60. End loop 64 includes a ring, eye, loop, clasp, slide, or the like 66 permanently attached to free end 60 via a piece of flexible material 68 folded over end 60 and permanently attached to member 52 by stitching, gluing, heat sealing, etc. 70. Slide 66 includes a central opening 72 having a dimension large enough to receive the end tab 62 and flexible member 52 therethrough. The slide 66 also includes a second smaller rectangular opening 74 which accommodates the passage of the material 68 therethrough for securing the slide 66 to the elongate member 52.

In accordance with yet another particular example of the present invention, the fastening device 50 is made of a length of VELCRO brand back-to-back, self-wrapping, reusable, woven/knit tape having an end tab at one end thereof and an end loop at the other end thereof. The end tab is made of a piece of flexible material wrapped over one end of the tape and permanently attached thereto by stitching with, for example, heavy duty thread or cord, or gluing, heat or sonic welding, or the like. When the material for the end tab is leather or other natural material it is preferred to stitch or sew it to the tape. When the end tab is formed of a synthetic cloth or fabric material it is possible to attach it to the elongate member by heat or sonic sealing or welding of the material to the synthetic hook and loop material. The end loop is a plastic or metal rectangular ring or loop with a piece of flexible material wrapped over a portion of the ring and over the end 60 of the tape and permanently attached to the tape by stitching, gluing, welding, or the like. It is preferred that the same material be used for the end tab 62 and to attach the end loop to the tape.

Figure 5:
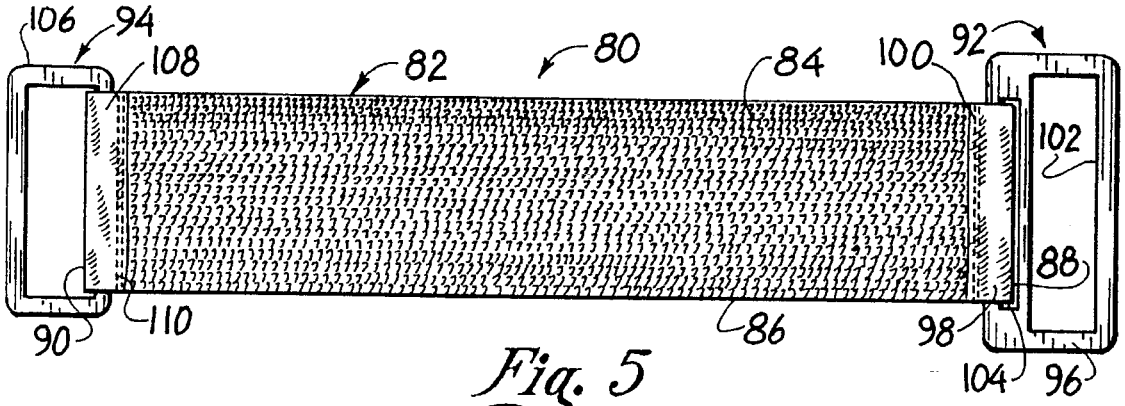
FIG. 5 is a bottom plan view illustration of a fastening device in accordance with still yet another embodiment of the present invention.

As shown in FIG. 5 of the drawings and in accordance with still yet another exemplary embodiment of the present invention, a fastening device or apparatus generally designated 80 is identical to the fastening device 50 of FIG. 4 with the exception of the end tab being replaced by a large sized end loop, and the slide 66 being replaced with a simple rectangular loop. Fastening device 80 includes an elongate flexible member or strap 82 having opposing releasably interlocking or coupling surfaces 84 and 86 and first and second free ends 88 and 90. A large size end loop 92 is located at the first end 88, and a second smaller size end loop 94 is located at second free end 90 of elongate member 82.

The large end loop 92 includes a slide, ring, loop, eye, clasp, or the like 96, attached to end 88 via a length of flexible material 98 wrapped around a portion of slide 96 and end 88 and permanently affixed to member 82 by stitching, gluing, sealing, or welding 100. Slide 96 includes a large rectangular central opening 102 dimensioned to allow the smaller end loop 94 and a portion of elongate member 82 to pass therethrough. Slide 96 further includes a smaller size rectangular opening 104 dimensioned to receive the flexible material 98 therethrough to provide for attachment of the slide 96 to the elongate member 82.

The smaller end loop 94 of fastening device 80 includes a ring, loop, eye, clasp, or slide 106 attached to the end 90 of elongate member 82 by a length of flexible material, fabric, or the like, 108 which is wrapped around one side of the ring 106 and over the end 90 and permanently attached to the elongate member 82 via stitching, gluing, sealing, welding, etc. 110. The material 98 and 108 is relatively smooth and devoid of hooks and loops and thereby facilitates the unobstructed movement of elongate member 82 through the opening 102.

Fastening device 80 may be used alone or together with one or more of the fastening devices 10, 30, 50 and 80 of FIGS. 1, 3, 4 and 5 of the drawings for securing, fastening, bundling, or the like, one or more objects or articles together or adjacent one another.

In accordance with a particular example of the present invention, the fastening device 80 is formed entirely of synthetic resinous materials including an elongate member of VELCRO brand synthetic hook and loop materials which adhere when pressed together, plastic end loops 96 and 106, and synthetic material 98 and 108 heat sealed or sonically welded to the hook and loop material.

In accordance with still yet another particular example of the present invention, a securing device having opposing interlocking or interengaging releasable surfaces and a pull tab or gripping surface at each of the free ends thereof is made up of an elongate section of flexible strap material having attached to respective opposing surfaces thereof respective VELCRO brand hook and loop synthetic filamentary tapes with the tapes covering the entire length of the elongate section of strap material with the exception of at least one-quarter of an inch at the free ends of the strap and substantially the entire width of the strap. In this example it is not necessary to add a flexible material over the ends of the strap to provide end tabs or gripping surfaces since the hook and loop material stops short of the ends of the strap and thereby the gripping surfaces are provided by omission of the interlocking materials. In order to improve the aesthetic or ornamental aspect of the fastening device, a different type, texture or color of material may be used for the elongate strap, synthetic filamentary tapes, and end tab material at one or both ends of the strap.

Figure 6:
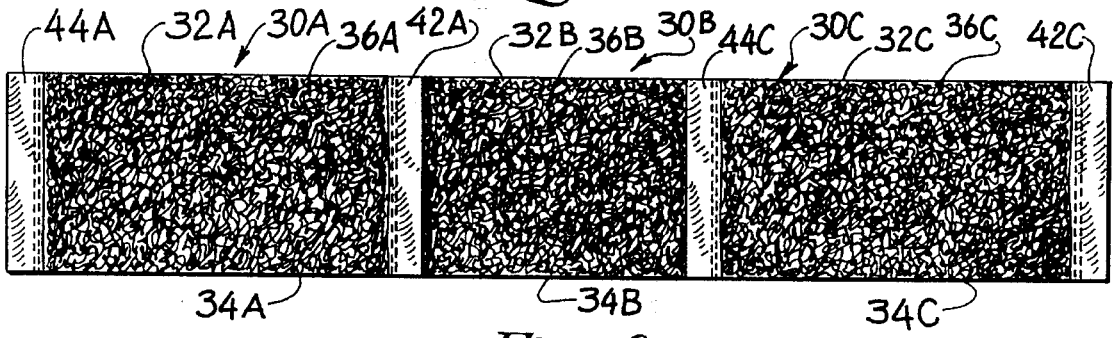
FIG. 6 is a top plan view representation of a plurality of fastening devices of the type shown in FIG. 3 attached to one another to provide an elongate fastening device or system.
Figure 7:
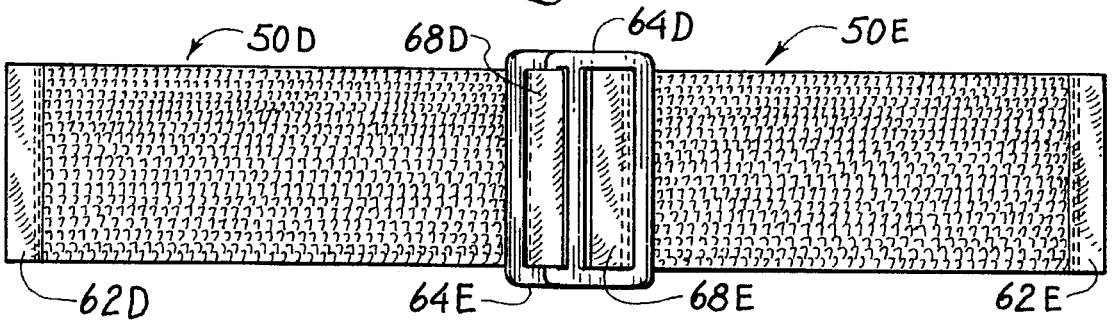
FIG. 7 is a bottom plan view representation of two of the fastening devices of the type shown in FIG. 4 with the end tab of one device passed through the end loop of the other, and the end loops brought together to form an elongate fastening device or system.

As shown in FIGS. 6 and 7 of the drawings, a plurality of fastening devices may be combined to form an elongate or extensible fastening device or fastening system for binding, bundling, fastening, securing or the like one or more objects or items together. With reference to FIG. 6 of the drawings, three of the fastening devices 30A, 30B, 30C of the type shown in FIG. 3 of the drawings are joined to form an elongate fastening 30A–30C device by overlapping a portion of the hook material surface 34A of device 30A with the loop material 36B of device 30B to form a first releasable coupling therebetween and overlapping a portion of the hook material 34C of device 30C with the loop material 36B of device 30B to form a second releasable coupling. The combined elongate device 30A–30C is then wrapped around one or more items and secured in position by overlapping a portion of the respective hook and loop materials of device 30A and 30C. It is contemplated that an unlimited number of fastening devices may be interconnected to form an elongate or extensible fastening device of indeterminate length as well as width. For example, the width of the fastening device may be increased by overlapping a portion near the side edge of adjacent fastening devices to form an elongate or extensible device or system of indeterminate width.

With reference to FIG. 7 of the drawings, a plurality of fastening devices 50D and 50E of the type shown in FIG. 4 of the drawings are joined to form an elongate, extensible, device or system for binding, fastening, securing, bundling, or the like, one or more items or objects. As shown in FIG. 7, the end tab 62D of fastening device 50D is passed through the opening in the slide or loop 64E of fastening device 50E to form a combined fastening device 50D–50E having substantially twice the length of the fastening device 50 of FIG. 4 of the drawings. This arrangement also leaves the opening in slide or loop 64D accessible for attaching accessories to a bundle, for hanging the bundle wrapped by the fastening devices 50D and 50E, or for providing for attachment of another fastening device 10, 30, or 50 of FIGS. 1–4 therethrough. Thus there is provided a very versatile and useful fastening device or system.

Figure 8:
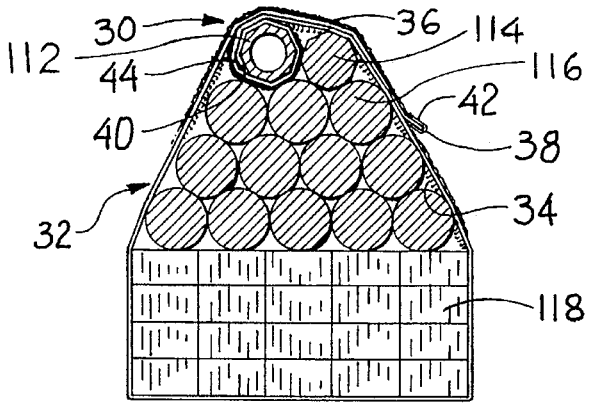
FIG. 8 is a side view illustration of the fastening device of the type shown in FIG. 3 with a first wrap thereof around a single item and a second wrap thereof around additional items.
Figure 9:
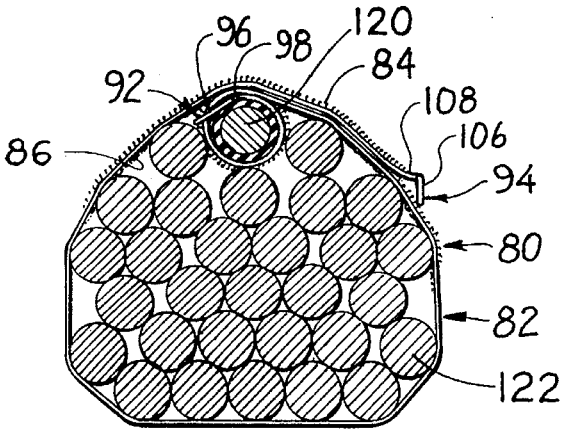
FIG. 9 is a side view illustration of the fastening device of the type shown in FIG. 5 in use with a first wrap around a single item, and a second larger wrap around additional items.

The fastening device, system and method of the present invention is especially suited for use as a keeper for one or more pieces of a coiled or rolled item such as a cable or a hose or diverse items or articles. As shown in FIGS. 8 and 9 of the drawings, a plurality of loops or wraps are formed in the fastening device by simply wrapping the device in a common direction and in a superimposed relation to form first, second and additional loops as necessary or desired.

With particular reference to FIG. 8 of the drawings, fastening device 30 is used for binding, bundling, transporting or the like a plurality of diverse articles 112, 114, 116 and 118 with a first loop of the device 30 wrapped around item or article 112 to serve as a keeper for holding the device 30 in place while it is wrapped around the remaining items in a second larger loop with the device being wrapped in a single or common clockwise direction. Starting at the end 40 fastening device 30 is wrapped around item 112 with a portion of the opposing interlocking or coupling surfaces contacting one another to form a first loop around item 112 and a first releasable coupling of the interlocking surfaces. Next, the remaining portion of the fastening device 30 is wrapped around the remaining items 114, 116 and 118 and superimposed over the first loop and upon itself in the second loop to provide for a second releasable coupling between the opposing interlocking surfaces 34 and 36 of the fastening device 30. End tab 42 at end 38 of elongate member 32 provides an easily gripped surface for removal of the fastening device.

In accordance with a particular example of the present invention, the items 112, 114, 116 and 118 are large items such as pipes, rods and lumber and the fastening device 30 is sized accordingly. For example, the device has an elongate member 32 with a width of at least four inches and a length of twelve feet. End tab 42 has a width of at least four inches to match the width of the elongate member 32 and a length of about four inches. With such a fastening device, the releasable coupling or interconnection between the opposing surfaces 34 and 36 of the member 32 is sufficient for bundling and transporting of large articles.

In accordance with another example of the present invention, fastening device 30 is used to form a combined package of the components of a tent with each of the components bound in one of a plurality of loops of the fastening device. First, the tent stakes are wrapped with a first loop of a fastening device, next the remaining portion of the fastening device is wrapped around the tent poles and back upon itself, and lastly the end portion of the fastening device is wrapped around the tent itself and back upon itself. Thus, three loops are formed using a single fastening device to create a package or fastening system having a plurality of loops or bundles.

With reference to FIG. 9 of the drawings, fastening device 80 of the type shown in FIG. 5 of the drawings is used to bundle, bind, clinch, or fasten a plurality of adjacent pieces of a rolled or coiled cable or the like. A first piece of the cable 120 is wrapped in a first loop of the fastening device 80 by passing the small end loop 94 through large end loop 92 and feeding as much of the elongate member 82 therethrough as possible. A portion of the opposing surfaces 84 and 86 of elongate member 82 are releasably joined to form a first releasable coupling and a first wrap or loop around piece 120. Thereafter, the remaining portion of elongate member 82 is wrapped around the remaining pieces of the coil or roll and back upon itself in a superimposed relation to form a second large loop with the elongate member 82 always being wrapped in a common singular clockwise direction. The small end loop 94 provides an easy gripping surface for removal of the fastening device 80 as well as the attachment of accessories to the bundle, the attachment of additional fastening devices or bundles, or the like.

As shown in FIG. 10 of the drawings, a plurality of fastening devices or a fastening system is used to combine a plurality of bundles of diverse items or articles 124, 126 and 128. A plurality of items 124 having a circular cross-section are bound or bundled adjacent one another by first fastening device 50F of the type shown in FIG. 4 of the drawings. The items 124 are bound together by passing the fastening device 50F around the items and pulling the end tab 62F and as much as possible of the elongate member 52F through the end loop 64F and compressively joining the opposing superimposed coupling surfaces of the elongate member 52F together to form a first releasable coupling.

Thereafter a second bundle is formed by wrapping the fastening device 50 around a plurality of rectangular items or articles 126, passing the end tab 62 and as much as possible of the remainder of elongate member 52 through end loop 64 and then through end loop 64F of fastening device 50F and compressively joining respective interlocking opposing surfaces of the fastening device 50 with the fastening device 50F to form a second releasable coupling therebetween. Also, a portion of the exterior of each of the first and second bundles (fastening devices 50F and 50) are compressively joined to form a third releasable coupling therebetween.

Lastly, a plurality of rectangular articles 128 are bundled together by wrapping the fastening devices 30 therearound and superimposing and compressively joining the respective opposing interlocking surfaces to form a fourth releasable coupling. Thereafter, this third bundle of the fastening device 30 and articles 128 is joined to the first and second bundles by pressing a portion of the exterior of the fastening device 30 into contact with a portion of the exterior of the fastening devices 50 and 50F, thus forming a fifth and sixth releasable couplings between the fastening device 30 and the fastening devices 50 and 50F, respectively. End tabs 44, 62 and 62F facilitate the removal and unbundling of the fastening devices or system. This highlights the versatility, adjustability and adaptability of the fastening apparatus and method of the present invention.

Thus it will be appreciated that as a result of the present invention, a highly effective, improved fastening apparatus and method is provided by which the principle objective among others is completely fulfilled. It is contemplated and will be apparent to those skilled in the art from the preceding description and accompanying drawings that modifications and/or changes may be made in the illustrated embodiments without departure from the present invention. Accordingly, it is expressly intended that the foregoing description and accompanying drawings are illustrative of preferred embodiments only, not limiting, and that the true spirit and scope of the present invention be determined by reference to the appended claims.

What is claimed is:

1. A versatile releasable fastening device consisting of an elongate flexible strap having a first free end, a second free end, a first surface and a second surface with each of said surfaces completely covered by respective releasably interlocking elements, at least one of said free ends having one of an end tab and an end ring, a first loop formed at one of said first and second ends of said strap and comprising said strap wrapped around one or more objects and upon itself in a singular direction with a portion of said first and second surfaces releasably interlocked, and at least a second loop comprising at least a portion of the remainder of said strap wrapped around one or more additional objects and upon itself in said singular direction with at least another portion of said first and second surfaces releasably interlocked.

2. The device as recited in claim 1 wherein said releasably interlocking elements comprise interengaging hooks over one of said first and second surfaces and loops over the other of said first and second surfaces with the exception of said end tab and said end ring.

3. The device as recited in claim 1 wherein said end tab comprises a length of material folded over and permanently attached to one of said free ends of said elongate strap to provide a gripping surface for ready detachment of said interlocking surfaces one from another.

4. The device as recited in claim 1 wherein said end ring comprises a ring sized to allow for passage of said strap therethrough and attached to one of said free ends of said strap by a length of material folded over one side of said ring and one of said free ends of said strap and permanently attached to said strap.

5. The device as recited in claim 1 having an end tab at each of said free ends of said strap.

6. The device as recited in claim 1 having an end tab at one of said free ends and an end ring at the other of said free ends of said strap.

7. The device as recited in claim 1 having an end ring at each of said free ends of said strap.

8. The device as recited in claim 1 having a small end ring at one of said free ends and a large end ring at the other of said free ends of said strap.

9. A versatile releasable fastening system comprising a plurality of said fastening devices as recited in claim 1.

10. A method of releasably fastening a plurality of objects together comprising the steps of wrapping said objects adjacent one another using at least one of said devices as recited in claim 1.

* * * * *